United States Patent [19]

Wilkinson et al.

[11] 4,300,868

[45] Nov. 17, 1981

[54] NOZZLE GUIDE VANE ASSEMBLY FOR A GAS TURBINE ENGINE

[75] Inventors: Wilfred H. Wilkinson, Turnditch; Harry Henshaw, Duffield, both of England

[73] Assignee: Rolls-Royce Limited, London, England

[21] Appl. No.: 92,088

[22] Filed: Nov. 6, 1979

[30] Foreign Application Priority Data

Nov. 25, 1978 [GB] United Kingdom ..... 46093/78

[51] Int. Cl.[3] ..... F01D 25/26

[52] U.S. Cl. ..... 415/137

[58] Field of Search ..... 415/135, 136, 137, 138, 415/139, 115

[56] References Cited

U.S. PATENT DOCUMENTS

| | | | |
|---|---|---|---|
| 2,799,473 | 7/1957 | Smith et al. | 415/137 |
| 2,903,237 | 9/1959 | Petrie et al. | 415/138 |
| 3,394,919 | 7/1968 | Catterfeld | 415/138 |
| 3,965,066 | 6/1976 | Sterman et al. | 415/138 |
| 4,083,648 | 4/1978 | Asplund | 415/137 |
| 4,126,405 | 11/1978 | Bobo et al. . | |

FOREIGN PATENT DOCUMENTS

| | | | |
|---|---|---|---|
| 2037380 | 7/1980 | United Kingdom | 415/138 |

*Primary Examiner*—Robert E. Garrett

*Attorney, Agent, or Firm*—Cushman, Darby & Cushman

[57] ABSTRACT

A nozzle guide vane assembly for a gas turbine engine comprises a circumferentially extending array of angularly spaced apart aerofoils each having projections adapted to engage with structure to retain the aerofoil in its longitudinal direction. Inner and outer platform members are separate from the aerofoils and each comprises a thicker support skin and a thinner inner skin. Both skins have aerofoil shaped apertures through which the aerofoils project, the support skin retaining the aerofoil against twisting, circumferential or axial loads and the inner skin serving to define a respective boundary of the gas flow through the assembly. The aerofoil is free to slide through the apertures sufficiently to permit relative expansion in a direction longitudinal of the aerofoil, and sealing means are associated with the inner skins and provide a seal between the skins and the aerofoils.

14 Claims, 10 Drawing Figures

NOZZLE GUIDE VANE ASSEMBLY FOR A GAS TURBINE ENGINE

This invention relates to a nozzle guide vane assembly for a gas turbine engine. In gas turbine engines the nozzle guide vane assembly is one of the most difficult areas of design because the vanes sustain the highest temperature in the engine and they must perform an efficient aerodynamic function on the hot gases which flow from the combustion chamber. In the past it has been the practice to make the nozzle guide vane assembly as an annular array of separate vanes, each vane comprising an aerofoil and inner and outer platforms formed integrally with the aerofoil. This is not necessarily the best way of making such an assembly because the aerofoil portions of the vanes require different characteristics to those of the platforms and in any case the platforms serve an aerodynamic and a load bearing function which normally result in the platform shape being a compromise between these two requirements.

The present invention provides a nozzle guide vane assembly in which the aerofoils are made separate from the platforms and in which the load bearing and aerodynamic functions of the platforms are separated to allow an improved design of assembly.

According to the present invention a nozzle guide vane assembly for a gas turbine engine comprises a circumferentially extending array of angularly spaced apart aerofoils, each aerofoil having projections adapted to engage with structure to retain the aerofoils in the radial direction and inner and outer platform members separate from the aerofoils and each comprising two skins, a thicker support skin having at least one aerofoil section aperture therein through which an aerofoil projects and which retains the aerofoil against twisting, circumferential or axial loads and a thinner inner gas contacting skin which also has at least one aerofoil section aperture therein through which the aerofoil projects, this skin serving to define the respective boundary of the gas flow through the assembly, the aerofoil being free to slide through the apertures sufficiently to permit relative expansions in a direction longitudinal of the aerofoil, and sealing means associated with each said inner skin adapted to form a seal between said inner skins and said aerofoils.

Said sealing means may comprise a resilient material, such as a spring washer or a silica cord held from the inner skin and sealing against the outer surface of the aerofoil.

Preferably the thicker support skin is apertured so that it acts as an impingement plate.

Either or both of the inner and the outer gas contacting skins may comprise an assembly of segments each of which engages with a plurality of aerofoils.

The inner and outer skins forming the outer platform may extend downstream so that they also comprise the static shroud of the turbine rotor immediately downstream of the vane assembly.

Figure 1:
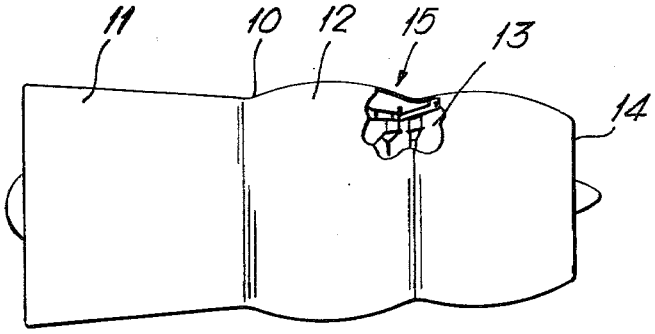
Figure 2:
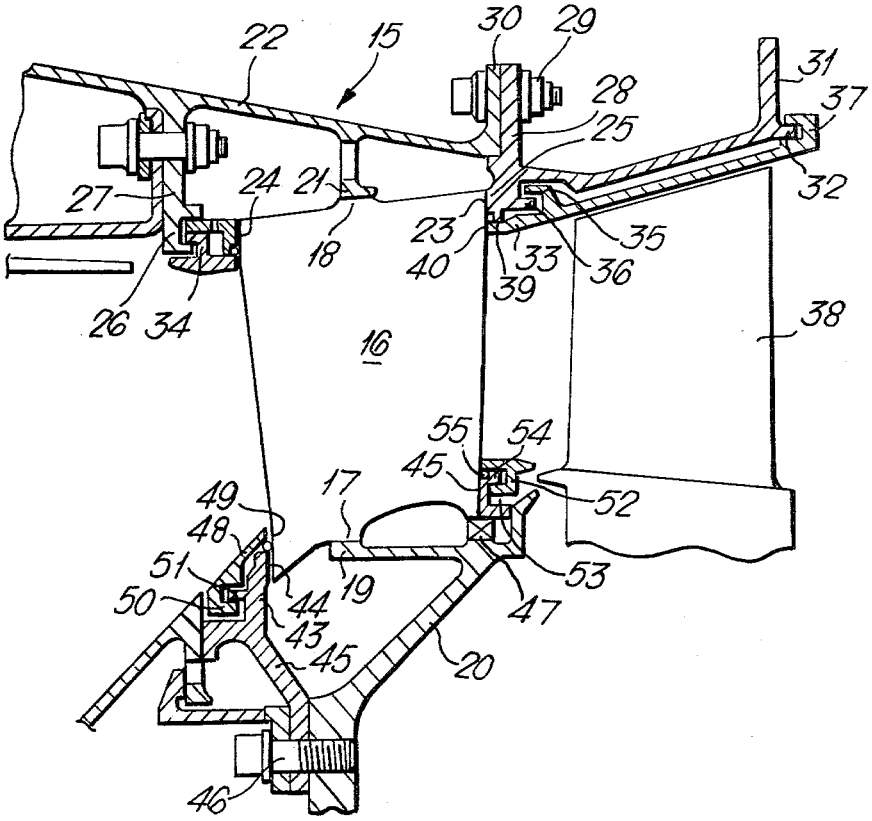
Figure 3:
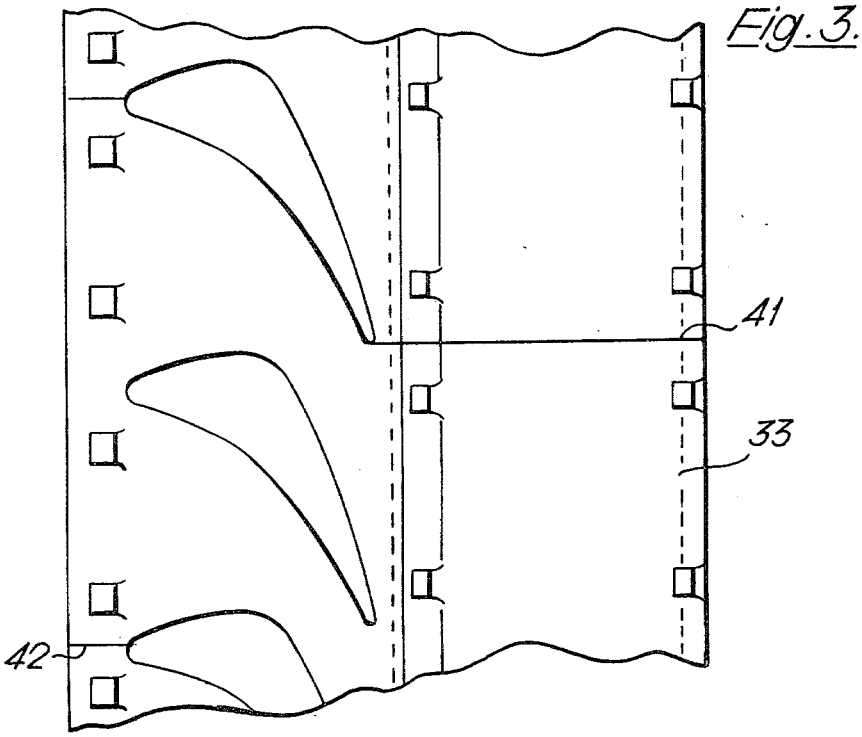
Figure 4:
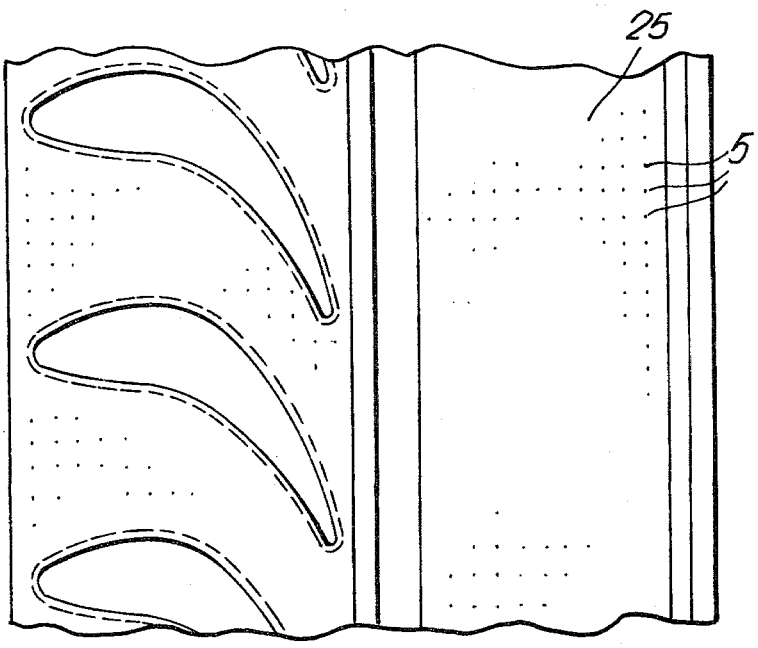
Figure 5:
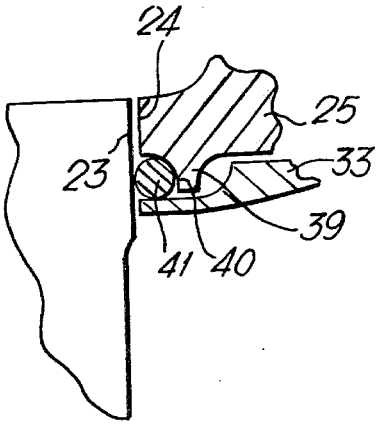
Figure 6:
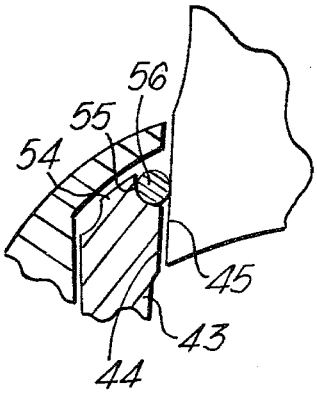
Figure 10:
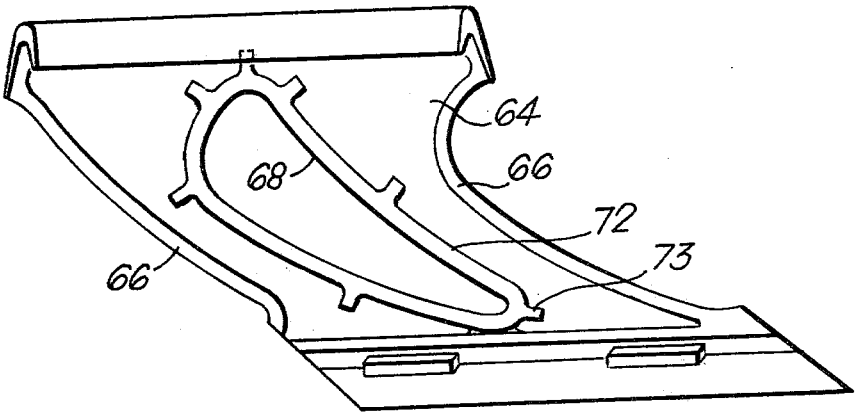
Figure 7:
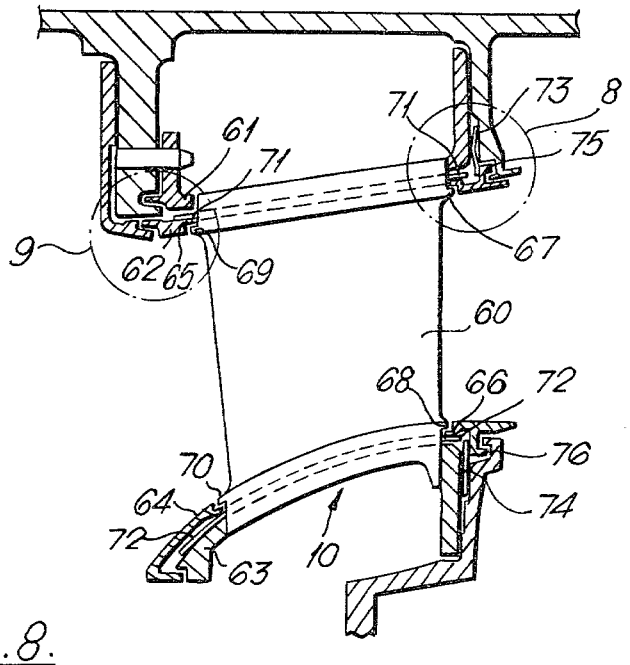
Figure 8:
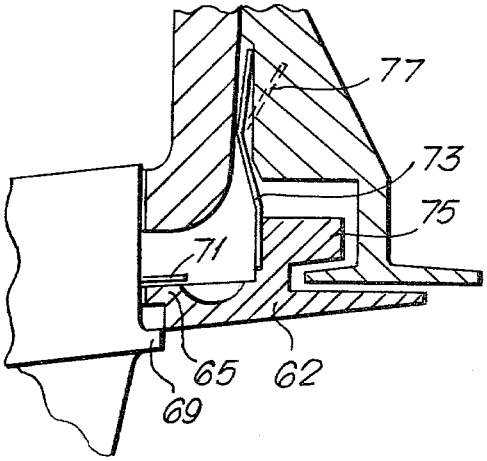
Figure 9:
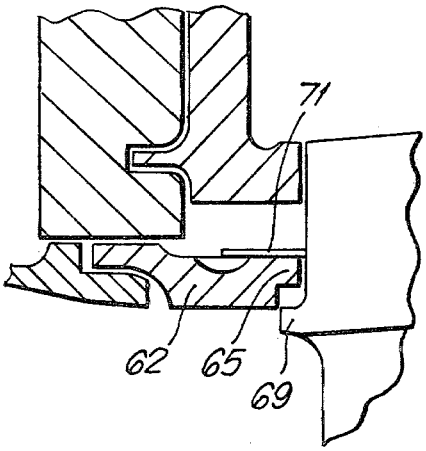

The invention will now be particularly described merely by way of example with reference to the accompanying drawings in which:

FIG. 1 is a partly broken away view of a gas turbine engine incorporating a nozzle guide vane assembly in accordance with the invention, FIG. 2 is an enlarged section through the nozzle guide vane assembly of FIG. 1, FIGS. 3 and 4 are developed views of the inner and outer skins of the outer platform of the assembly of FIG. 2, FIGS. 5 and 6 show in enlarged section, the arrangements used to seal the platform skins to the vane aerofoils, FIG. 7 is a view similar to FIG. 2 but of an alternative embodiment, FIGS. 8 and 9 are enlarged views of the portions marked 8 and 9 in FIGS. 7, and FIG. 10 is a view of the underside of the inner platform of FIG. 7 on the arrow 10.

In FIG. 1 there is shown a gas turbine engine comprising a casing 10 within which are mounted the normal sequence of compressor 11, combustion system 12 and turbine 13 and which forms a final nozzle 14. To direct the hot gases from the combustion chamber 12 onto the turbine 13 a nozzle guide vane assembly generally indicated at 15 is provided, and the casing 10 is broken away to indicate the overall configuration of the assembly 15.

FIG. 2 shows the assembly 15 in an enlarged cross section. It will be seen that the assembly comprises a plurality of aerofoils 16 which are mounted in a circumferential array each aerofoil extending substantially radially and being angularly spaced apart from its neighbours by a constant amount. Each aerofoil 16 is provided at its inner and outer extremities with projecting pads 17 and 18 respectively. The inner pad 17 engages with an annular supporting member 19 which in turn carried from a frustoconical mounting flange 20 which forms part of the fixed structure of the engine. Similarly the outer pads 18 engage with a flange 21 which projects from a casing 22 which is again part of the fixed engine structure. Engagement between the pads 17 and 18 and the members 19 and 21 retains the aerofoil 16 against radial movement while flexibility in the mountings, particularly inbetween the member 19 and the flange 20 allows for relative expansion between the aerofoils and the fixed structure.

At its outermost extremity the aerofoil 16 provided with a land 23 which is in effect a slightly raised portion of the aerofoil surface and which extends completely around the tip of the aerofoil. The land 23 fits within a correspondingly shaped aperture 24 in a support skin 25. The size of the aperture 24 is arranged to be very close to that of the land 23 but is not such as to provide an interference. In this way the end portion of the aerofoil is allowed to slide axially with respect to the skin 25 while being located in all other directions.

The skin 25 extends rearwardly from its engagement in an annular groove 26 in a flange 27 which extends from the casing 22. Just downstream of the aerofoil 16 the support skin 25 is provided with an integral flange 28 which is secured by a series of bolts 29 to an end flange 30 formed on the casing 22. The skin 25 extends further downstream to terminate in a second flange 31 which extends radially outwards and engages with structure which is not shown and an annular projection 32 whose purpose is described below.

The skin 25 is generally arranged to be of sufficient strength to carry all the loads acting in its own plane from the aerofoil 16 to the fixed structure and in particular to the casing 22. Fastened to the underside of the skin 25 there is a thinner inner skin 33. This skin again has aerofoil apertures formed therein through which the aerofoils 16 pass in a close fitting but non-interfering relationship and its lower surface is formed with a smooth aerodynamic shape so that it defines the outer boundary of the gas passage through the vane assembly 15. In order to support the skin 33 it is provided at its forward extremity with a series of hooks 34 which engage in the groove 26 together with the forward extremity of the skin 25. A second array of hooks 35 engage in a corresponding feature 36 formed on the inner face of the skin 25 in the region of the base of the flange 28. Finally, the downstream extremity of the skin 33 has a third series of hooks 37 which engage with the projection 32 from the skin 25.

It will be seen that the inner skin 33 also extends beyond the ends of the aerofoil 16 and in fact additionally defines the outer boundary of the flow passage through the first stage turbine rotor 38.

As described so far there is some danger that unless the fit between the land 23 and the apertures 24 in the skin 25 is extremely good there may be excess leakage of high pressure cooling air from the space between the casing 22 and the skin 25 or of hot gases from the gas stream into this space. In order to reduce this potential leakage to a minimum the skin 25 is provided with a raised lip 39 (see FIG. 5) which extends round each of the apertures 24 and which is itself formed with a rebate 40 on its inner edge. Within the rebate 40 a sealing material is engaged. This may comprise any suitable resilient, heat resistant material, but in the present embodiment a silica cord 41 is used. This cord may be arranged to be a tight fit in the rebate 40 so that it not only provides an effective gas seal but also reduces the likelihood of fretting of the aerofoil within the apertures 24.

FIGS. 3 and 4 show the developed appearance of the upper surfaces of the skins 33 and 25 respectively and it should be particularly noted that the skin 33 is split at lines 41 and 42 into separate segments. These segments abut together to form a complete ring. It will be seen that the abutments between the segments are arranged to take place about one of the aerofoils 16. In this way the presence of the apertures in the skins, which are necessary to allow the aerofoils to protrude is used to reduce the length of abutment, which requires sealing. It will also be noted from the view of FIG. 4 that the skin 25 is provided with a large number of apertures 57. These apertures are impingement cooling apertures, and as is well known in the art, by causing cooling fluid at high pressure to flow through these apertures and to impinge upon the skin 33 an efficient cooling of the skin 33 may be provided.

Thus far only the outer platform made up of the skins 33 and 25 has been described. The inner platform is made up in a manner similar in principle. In this case a thicker support skin 43 is provided with apertures 44 through each of which passes a land 45 on the aerofoil 16 which is similar to the land 23. Although the skin 43 is of a different shape to the skin 25 it carries out a similar function in carrying out loads from the aerofoil 16, and the aerofoil is again free to slide axially with respect to the skin. In the case of the skin 43 an inwardly extending flange 45 is bolted at 46 to fixed structure of the engine.

In this case the fixed structure comprises the radially inner portion of the flange 20. At its rearward extremity the skin 43 engages by way of a dogged connection 47 with the extremity of the flange 20. In this way the skin 43 is retained at its forward and rearward extremities. A thin inner skin 48 overlays the skin 43. In a similar manner to the skin 33 the skin 48 carries very few loads and it can therefore be very light and aerodynamically very smooth. The skin 48 has its own aerofoil apertures 49 through each of which a land 45 passes. To secure the skin 48 at its forward extremity it is provided with a series of hooks 50 which engage beneath a forwardly projecting lip 51 from the inner skin 43. At its rearward extremity the skin 48 has a second series of hooks 52 which in this case engage in a groove 53 in the rearward extremity of the skin 43.

In an exactly similar manner to the outer platform it is necessary to ensure that the gap between the skin 43 and the land 45 is sealed and to this end the skin 43 has a projection 54 (see FIG. 5) all around the aerofoil shaped aperture 49 which is formed with a rebate 55 on its innermost edge. Again in this rebate a silica cord 56 is retained so as to provide the necessary sealing.

The skins 43 and 48 forming the inner platform may be provided with exactly similar impingement cooling arrangements to those described with respect to the skins forming the outer platform.

It will be seen that the construction described enables the supporting function of the platform to be separated from its aerodynamic function and in this way these two functions can be properly carried out without compromise. Differential expansion between the aerofoil and the platforms, and replacement of the aerofoils, is allowed by the axial sliding possible between the aerofoils and the various skins. Additionally, a structure can be made which is relatively light in weight and in which any of the separate portions can be relatively easily removed and replaced for repair purposes.

FIGS. 7–10 illustrate a further embodiment which is similar in basic concept to that of FIGS. 2–6 but which uses a different construction to locate the aerofoils axially, and to seal between the aerofoils and the skins forming the platforms of the vanes.

Once again it will be seen that aerofoils 60 extend between inner and outer platform assemblies. The outer assembly comprises an outer load bearing skin 61 and a thin inner skin 62 broadly similar to the skins 25 and 33 of the FIG. 2 embodiment. The inner assembly likewise has an outer load bearing skin 63 and a thin inner skin 64 which corresponds with the skins 43 and 48 respectively. The outer skins may again be apertured to serve as impingement plates. In the present embodiment, however, the thin inner skins 62 and 64 are provided with flanges 65 and 66 which extend round the apertures 67 and 68 through which the ends of the aerofoil 60 extend.

These flanges serve a dual purpose. Thus they strengthen the thin inner skins so that they can withstand high gas load acting across them. This may be necessary when a large pressure drop across the vane stage leads to a large change in pressure across the inner surfaces of the thin skins while their outer surfaces are subject to a relatively uniform pressure. Secondly, the flanges cooperate with shoulders 69 and 70 to prevent any substantial axial movement of the aerofoils with respect to the platform assemblies. In this respect the shoulders and flanges replace the pads 17 and 18 of FIG. 2 and their various abutments.

It will be noted that although the shoulders and flanges operate to locate the aerofoil, they are arranged to allow the aerofoil to have sufficient clearance to take up differential expansions. Thus it will be seen from FIGS. 8 and 9 that a clearance is left between the flange 65 and the shoulder 62. Since the aerofoil is arranged to be a sliding fit within the apertures 67 and 68, it can move longitudinally sufficient to take up differential expansions.

As in the previous embodiment, the fact that the aerofoil engages within the apertures 67 and 68 so that sliding motion is permitted, introduces the possibility of leakage between the aerofoil and the platforms. Therefore, sealing means is provided in the form of spring washers 71 and 72 whose internal apertures are a very close fit over the outside of the relevant parts of the aerofoil. FIG. 10 shows the shape of the washer 72 which will be seen to comprise a spring washer whose shape follows the external contour of the relevant part of the aerofoil and which has projections as at 73 which serve to react the spring forces on the washer into the platform structure.

It will also be noted that further spring washers 73 and 74 are provided to seal the downstream extremities of the inner skins 62 and 64 respectively to fixed structure. These washers comprises simple rings, whose section is arranged to cause them to press against the hooked flanges 75 and 76 which project from the skins and against the fixed structure. Thus FIG. 8 shows how the washer 73 has a portion shown in broken lines at 77 which, when under formed forms a part-conical ring. When this portion is trapped between the skin 61 and the adjacent stationary structure it therefore presses against, and seals against the adjacent structure. Similarly the body of the washer is also forced against the flange 75. Thus the washers 73 and 74 provide effective seals at the downstream ends of the platforms.

It should be understood that it is possible to use the invention in ways which differ from that described in relation to the drawings. Thus in particular the detailed mounting arrangements for the various skins could easily be altered and it should be noted that it would be possible to use ceramics rather than the conventional metal for various of the parts of the assembly.

We claim:

1. A nozzle guide vane assembly for a gas turbine engine comprising a circumferentially extending array of angularly spaced apart aerofoils, retaining structure for the aerofoils and projections from each aerofoil adapted to engage with the retaining structure to retain the aerofoils in their longitudinal direction, inner and outer platform members separate from the aerofoils and each comprising two skins, a thicker support skin having at least one aerofoil section aperture therein through which one said aerofoil projects and which retains the aerofoil against twisting, circumferential or axial loads and a thinner inner gas contacting skin which also has at least one aerofoil section aperture therein through which the aerofoil projects, said thinner inner gas contacting skin serving to define the respective boundary of the gas flow through the assembly, the aerofoil being free to slide through the apertures sufficiently to permit relative expansions in a direction longitudinal of the aerofoil, and sealing means associated with each said inner skin adapted to form a seal between said inner skin and said aerofoils.

2. A nozzle guide vane assembly as claimed in claim 1 and in which said sealing means comprises a resilient member held from said inner skin and sealing against the outer surface of said aerofoil.

3. A nozzle guide vane assembly as claimed in claim 2 and in which said resilient member comprises a spring washer.

4. A nozzle guide vane assembly as claimed in claim 2 and in which said resilient member comprises a fibrous, heat resistant material.

5. A nozzle guide vane assembly as claimed in claim 4 and in which said resilient member comprises a silica cord.

6. A nozzle guide vane assembly as claimed in claim 1 and in which said projections from said aerofoil comprise pads extending from the extremities of the aerofoil and said retaining structure comprises adjacent fixed structure of the engine.

7. A nozzle guide vane assembly as claimed in claim 1 and in which said projections from said aerofoil comprise shoulders on the aerofoil adapted to cooperate with said inner skins to retain the aerofoil in its longitudinal direction.

8. A nozzle guide vane assembly as claimed in claim 7 and in which flanges are provided on said inner skins adapted to act as an abutment for the shoulders on the aerofoil.

9. A nozzle guide vane assembly as claimed in claim 1 and comprising additional sealing means adapted to seal between the downstream edge of said platform members and fixed structure of the engine.

10. A nozzle guide vane assembly as claimed in claim 9 and in which said additional sealing means comprises spring washers.

11. A nozzle guide vane assembly as claimed in claim 1 and in which one said thicker support skin is apertured to act as an impingement plate.

12. A nozzle guide vane assembly as claimed in claim 1 and in which one of said skins comprises an assembly of segments each of which engages with a plurality of said aerofoils.

13. A nozzle guide vane assembly as claimed in claim 11 and in which the division between adjacent segments embraces one said aerofoil, the end faces of the adjacent segments being shaped to bear against the opposed surfaces of the aerofoil.

14. A nozzle guide vane assembly as claimed in claim 13 and in which there is a turbine rotor stage downstream of the assembly, the inner skin of the outer platform assembly extending downstream to define the outer flow boundary of the flow passage through the turbine rotor stage.

* * * * *